US012465810B1

(12) United States Patent
Lan et al.

(10) Patent No.: US 12,465,810 B1
(45) Date of Patent: Nov. 11, 2025

(54) TREADMILL RUNNING PLATFORM STRUCTURE

(71) Applicant: Hangzhou Xinyuan Electronic Technology Co., Ltd., Hangzhou (CN)

(72) Inventors: Fuhui Lan, Hangzhou (CN); Yu Hou, Hangzhou (CN); Weibo Luo, Hangzhou (CN)

(73) Assignee: Hangzhou Xinyuan Electronic Technology Co., Ltd., Hangzhou (CN)

( * ) Notice: Subject to any disclaimer, the term of this patent is extended or adjusted under 35 U.S.C. 154(b) by 0 days.

(21) Appl. No.: 19/075,835

(22) Filed: Mar. 11, 2025

(30) Foreign Application Priority Data

Jul. 12, 2024 (CN) ..... 202421655698.6

(51) Int. Cl.
*A63B 22/02* (2006.01)

(52) U.S. Cl.
CPC ..... *A63B 22/0235* (2013.01); *A63B 22/0221* (2015.10)

(58) Field of Classification Search
CPC . A63B 22/0221; A63B 22/0235; A63B 22/02; A63B 22/0207; A63B 22/0214
See application file for complete search history.

(56) References Cited

U.S. PATENT DOCUMENTS 9,011,296 B2 * 4/2015 Peralo ..... A63B 23/03575 482/123
9,452,314 B2 * 9/2016 Hou ..... A63B 22/0214
11,332,901 B1 * 5/2022 Eckerman ..... B63B 29/20

* cited by examiner

*Primary Examiner* — Megan Anderson
(74) *Attorney, Agent, or Firm* — JEEN IP LAW, LLC

(57) ABSTRACT

A treadmill running platform structure is provided, which includes a running platform, a running board, and a running belt. The running board includes two soft elastic strips adapted to two side bars of the running platform, a plurality of rigid support strips provided between the soft elastic strips, and strip-shaped connection plates respectively connected to two ends of the rigid support strips. Two strip-shaped connection plates are connected above the rigid support strips, and the strip-shaped connection plates are respectively fixed to a corresponding end of each rigid support strip. The present disclosure can achieve buffering of the entire running board, especially by connecting the rigid support strips together through the strip-shaped connection plates, thereby avoiding an uneven transition of the rigid support strips when a runner steps on the running board, improving the comfort of the runner's feet, and reducing the noise of the treadmill.

9 Claims, 8 Drawing Sheets

TREADMILL RUNNING PLATFORM STRUCTURE

CROSS-REFERENCE TO RELATED APPLICATIONS

This application claims priority to Chinese Patent Application No. 202421655698.6, filed on Jul. 12, 2024, which is hereby incorporated by reference in its entirety.

TECHNICAL FIELD

The present disclosure relates to the field of sports and fitness equipment technologies, and in particular, to a treadmill running platform structure.

BACKGROUND

Treadmills are a commonly used sports and fitness equipment. With a continuous improvement of people's living standards, more and more treadmills have entered ordinary households, so the requirements for treadmills are also increasing. Prior art treadmills typically include components such as a running platform, a running board, and a running belt. The running platform is a frame-shaped structure, two sides of the running board are fixed to side bars corresponding to opposite sides of the frame. The running belt is installed on the running platform through front and rear rollers and surrounds upper and lower parts of the running board. The running board serves as support for a runner to engage in running activities, while the side bars are used to support the running board. The runner stands on the running board through a belt, and when the belt is moved, the runner needs to maintain his position on the running board through running. The running board of the existing technology is usually a rigid flat plate, which brings discomfort to the runner's movement. In order to improve the comfort of running, a running board structure of a treadmill in the existing technology is supported by springs or elastic rubber pads at a local position below the running board to provide cushioning for the runner when stepping. The treadmill of the existing technology mainly has the following drawbacks as follows.

Firstly, due to the fact that buffering components such as springs are located locally, they cannot provide cushioning for the entire treadmill. As a result, the runner may still experience hard contact when stepping on the treadmill, which can easily cause impact on his knee and ankle joints, which results in injuries and discomfort.

Secondly, treadmills are prone to producing noise, which brings discomfort to the surrounding environment.

SUMMARY

The purpose of the present disclosure is to overcome the shortcomings of existing technology and provide a treadmill running platform structure. Through structural improvement, it can achieve buffering of the entire running board, thereby avoiding the damage caused by hard contact to the knee and ankle joints of a runner when stepping on the running board, and reducing the noise of the treadmill.

The technical solution adopted by the present disclosure to solve its technical problem is: a treadmill running platform structure, including a running platform, a running board, and a running belt; the running platform includes a frame-shaped component, and is further provided with a motor configured to drive the running belt to move and a transmission mechanism; the running belt is adapted to the running platform through the transmission mechanism and wraps around up and down of the running board from front and back of the running board; two sides of the frame-shaped component of the running platform are provided with side bars on two opposite sides of the corresponding frame-shaped component; where the running board includes soft elastic strips adapted to the two side bars of the running platform, a plurality of rigid support strips provided between the two soft elastic strips, and strip-shaped connection plates respectively connected to two ends of the plurality of rigid support strips; the two strip-shaped connection plates are connected above the rigid support strips, and the strip-shaped connection plates are respectively fixed to a corresponding end of each of the rigid support strips.

In some embodiments of the present disclosure, the strip-shaped connection plates are fixed to corresponding ends of the rigid support strips through a socket head cap screw.

In some embodiments of the present disclosure, uppers of the two soft elastic strips are provided with notch recesses, and two ends of the rigid support strips are respectively embedded in the notch recesses of the two soft elastic strips.

In some embodiments of the present disclosure, on the side bars of the running platform, stop members are respectively provided at two ends of the notch recesses corresponding to the soft elastic strips.

In some embodiments of the present disclosure, the running board further includes a thin wear-resistant plate, and the thin wear-resistant plate covers on the plurality of rigid support strips.

In some embodiments of the present disclosure, one end of the thin wear-resistant plate is fixed to one corresponding rigid support strip, and the other end of the thin wear-resistant plate is clamped on a top of another corresponding rigid support strip.

In some embodiments of the present disclosure, one end of the thin wear-resistant plate is fixed to the corresponding rigid support strip by a countersunk screw.

In some embodiments of the present disclosure, corresponding ends of the strip-shaped connection plates are provided with a clamping piece, and the other end of the thin wear-resistant plate is clamped on the corresponding rigid support strip through the clamping piece.

In some embodiments of the present disclosure, the clamping piece is a Z-shaped metal sheet, one end of the Z-shaped metal sheet is fixed to the corresponding end of the strip-shaped connection plates by a screw, and the other end of the Z-shaped metal sheet presses the other end of the thin wear-resistant plate against the corresponding rigid support strip.

In some embodiments of the present disclosure, the two strip-shaped connection plates are respectively a thin spring steel plate.

Compared with existing technology, the beneficial effects of the present disclosure are as follows.

The present disclosure adopts the running board, which includes soft elastic strips adapted to the two side bars of the running platform, a plurality of rigid support strips adapted between the two soft elastic strips, and strip-shaped connection plates respectively connected to the two ends of the plurality of rigid support strips; two strip-shaped connection plates are connected above the rigid support strips, and the strip-shaped connection plates are respectively fixed to a corresponding end of each rigid support strip. The structure of the present disclosure achieves elastic buffering of the entire running board through the soft elastic strips on the two side bars, especially by connecting the rigid support strips together through the strip-shaped connection plates, thereby avoiding an uneven transitions of the rigid support strips when a runner step on the running board, improving the comfort of the runner's feet, and the soft elastic strips can provide buffering effect on the side bars, thereby eliminating the noise generated by treadmill movements.

The following provides a further detailed explanation of the present disclosure in combination with the accompanying drawings and embodiments. However, the treadmill structure of the present disclosure is not limited to the embodiments.

DESCRIPTION OF EMBODIMENTS

Figure 1:
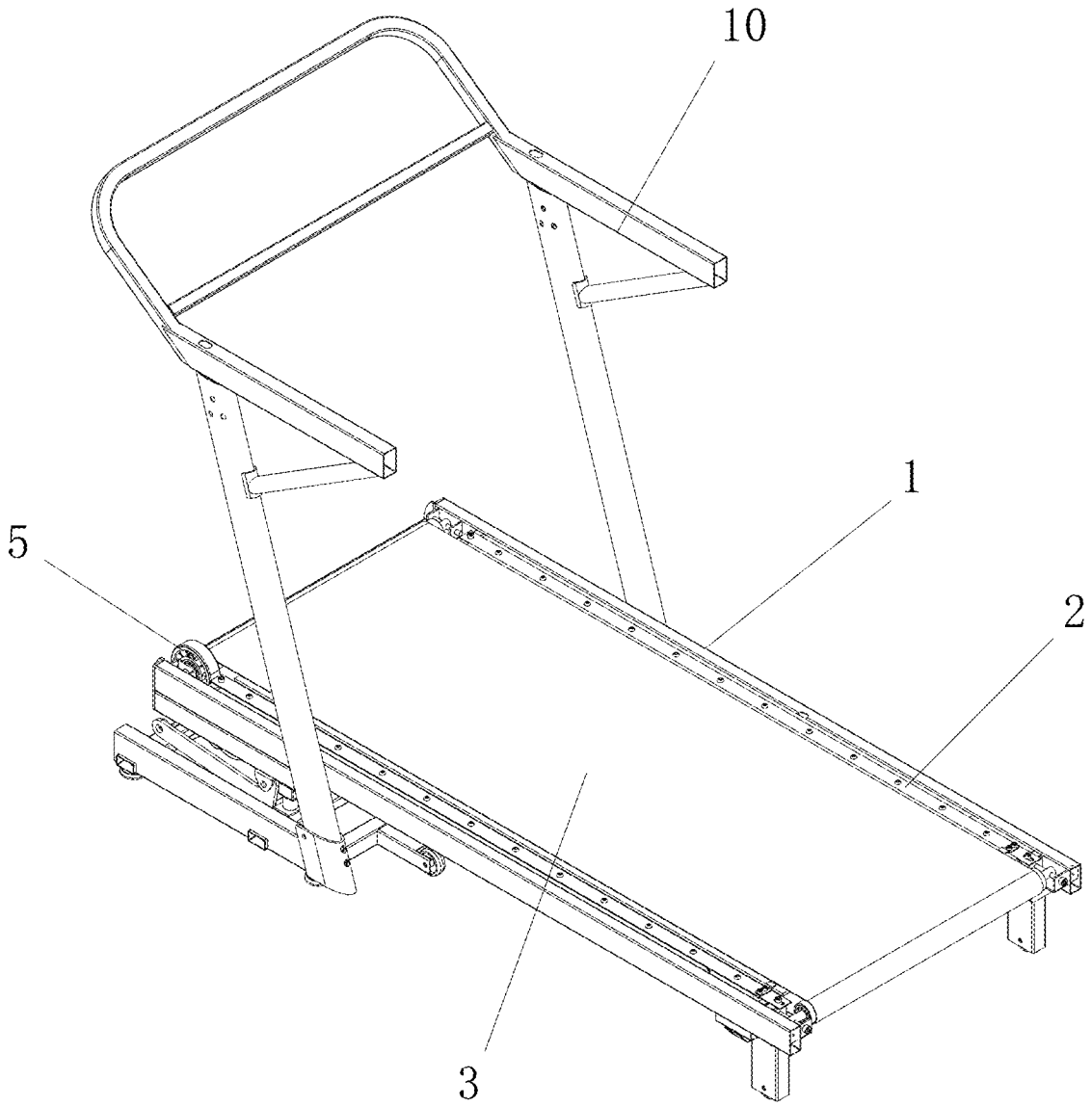
FIG. 1 is a first three-dimensional structural schematic diagram of a treadmill of the present disclosure.
Figure 2:
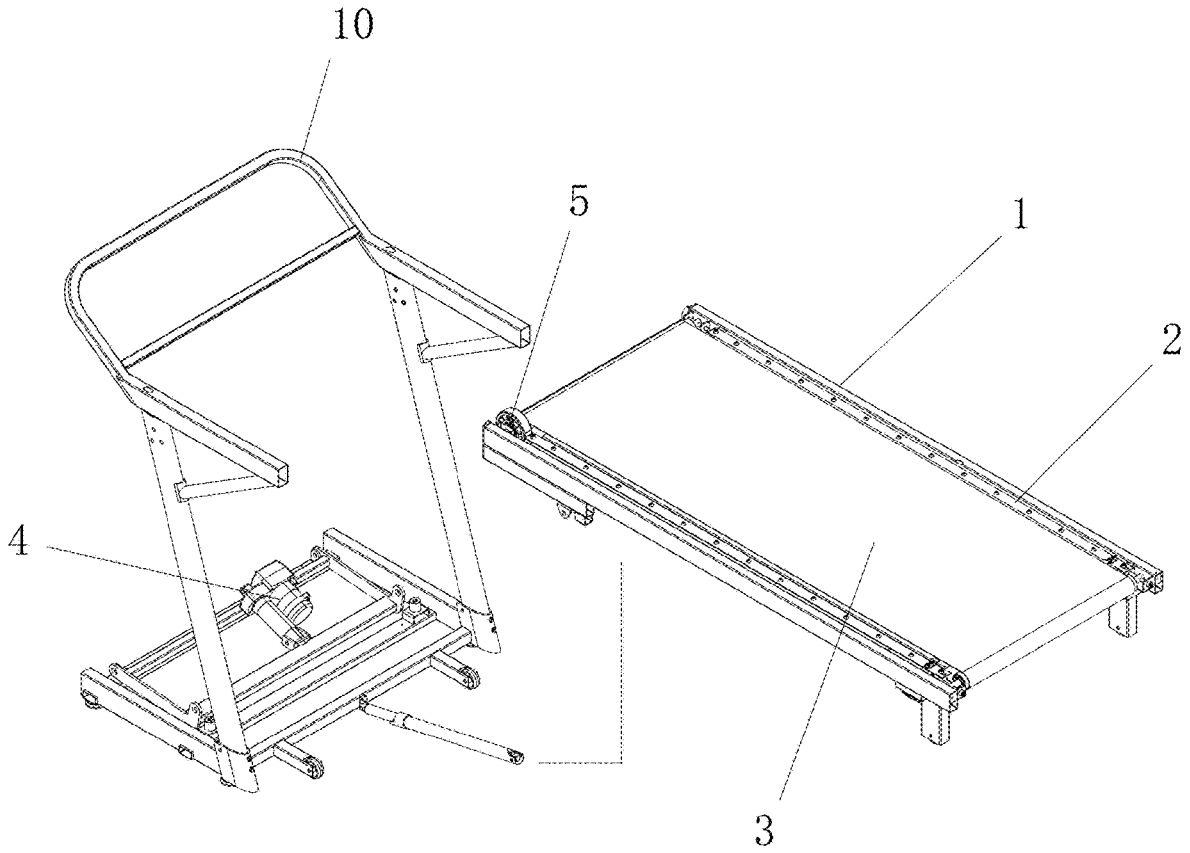
FIG. 2 is a second three-dimensional structural schematic diagram of the treadmill of the present disclosure (a running platform being separated from an armrest).
Figure 3:
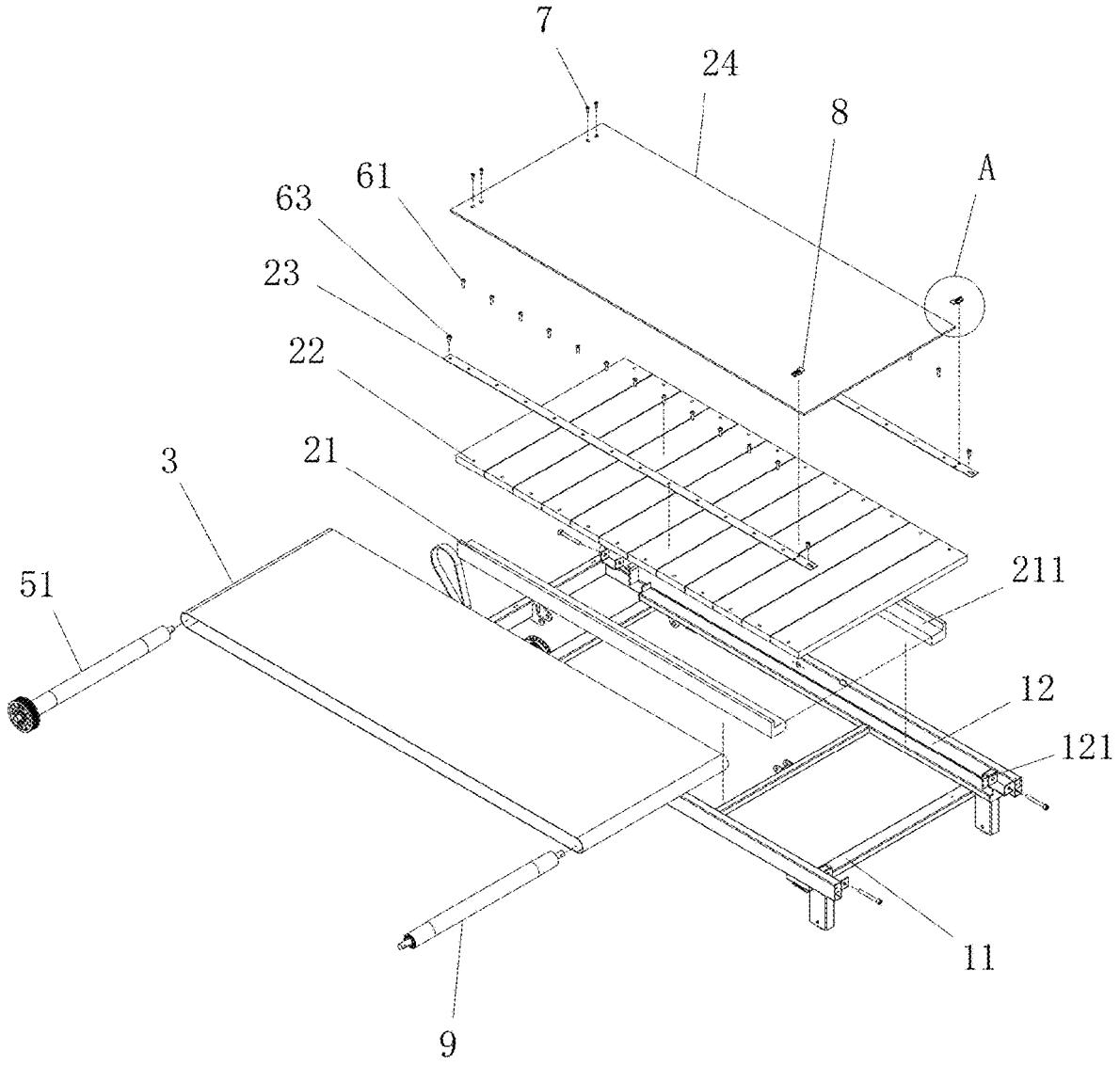
FIG. 3 is an exploded structural schematic diagram of the running platform of the present disclosure.
Figure 4:
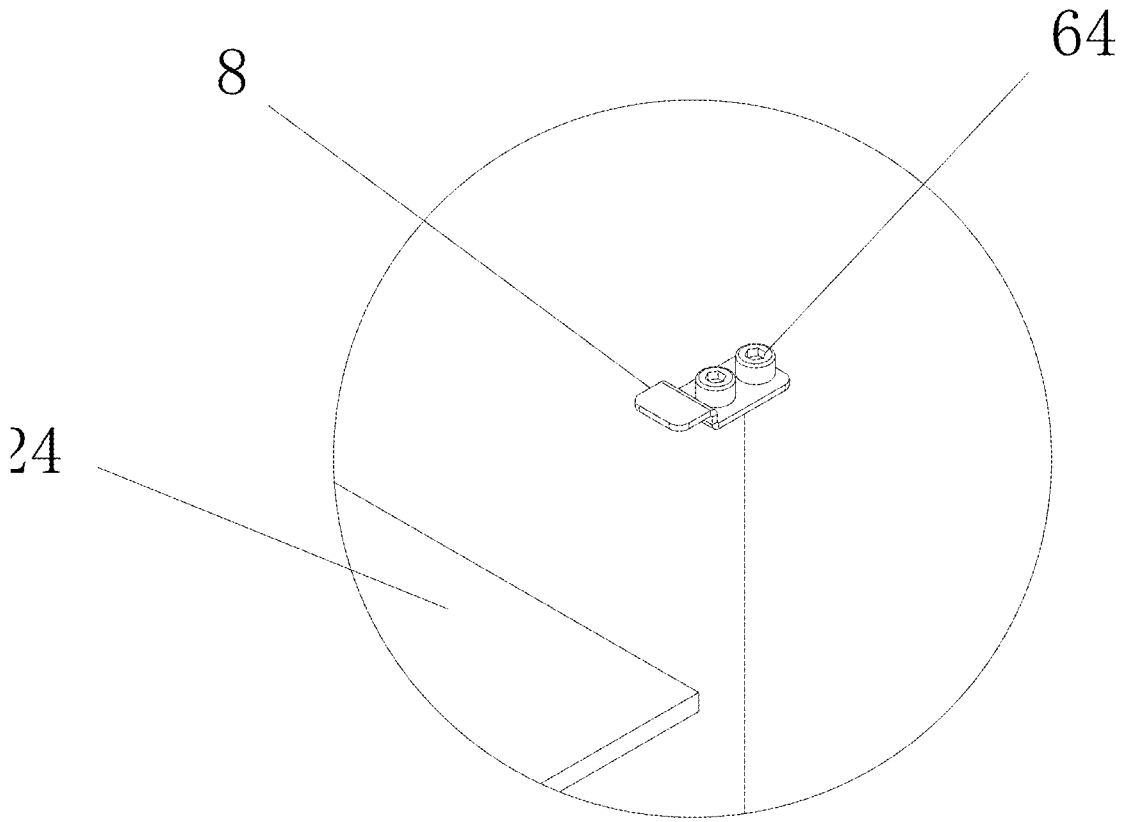
FIG. 4 is an enlarged schematic diagram of point A in FIG. 3.
Figure 5:
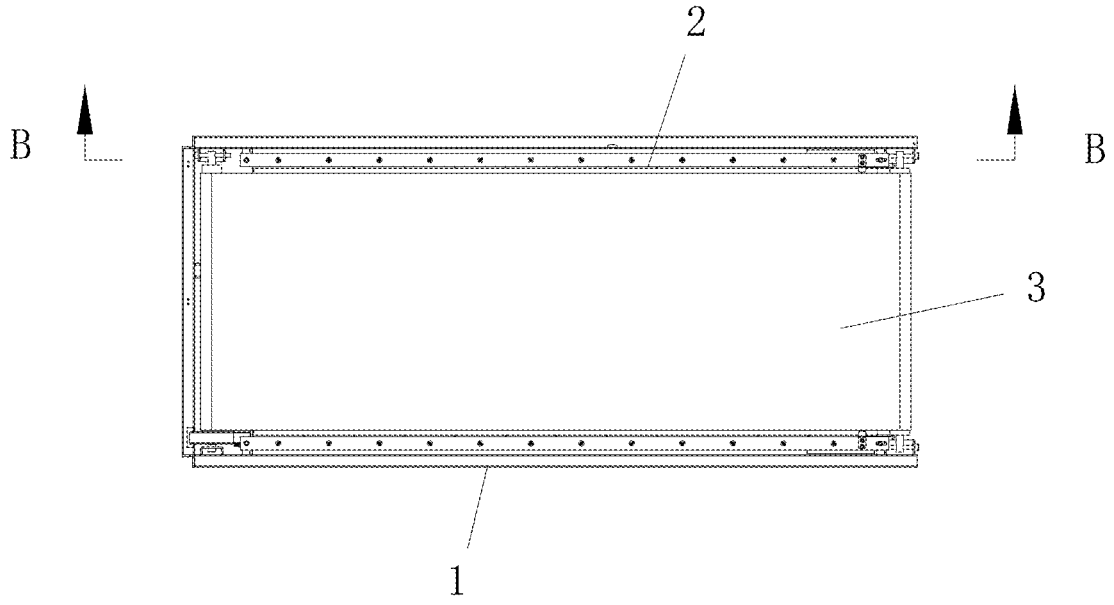
FIG. 5 is a top view of the running platform structure of the present disclosure.
Figure 6:
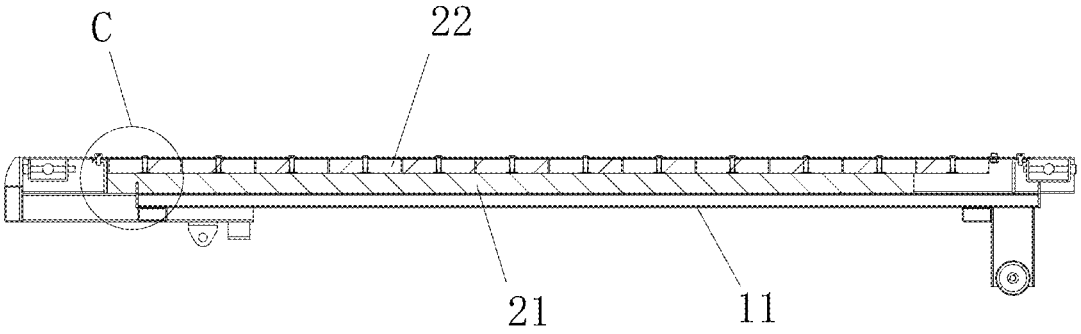
FIG. 6 is a schematic cross-sectional view taken along line B-B in FIG. 5.
Figure 7:
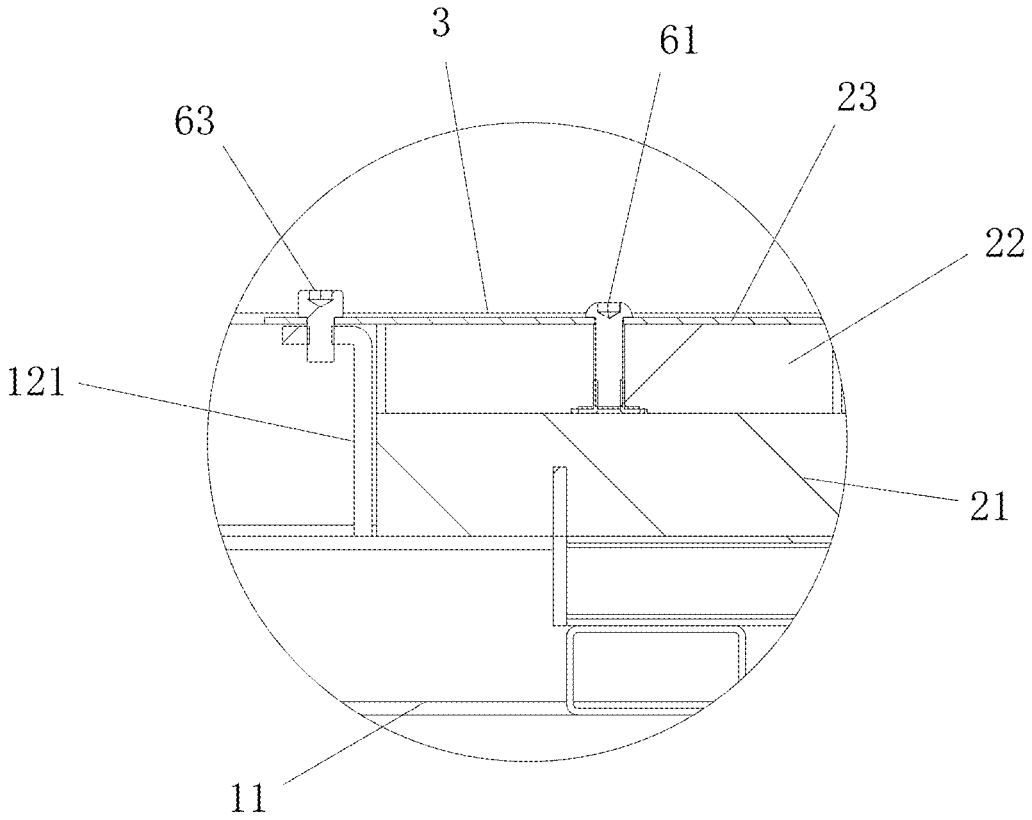
FIG. 7 is an enlarged schematic diagram at point C in FIG. 6.
Figure 8:
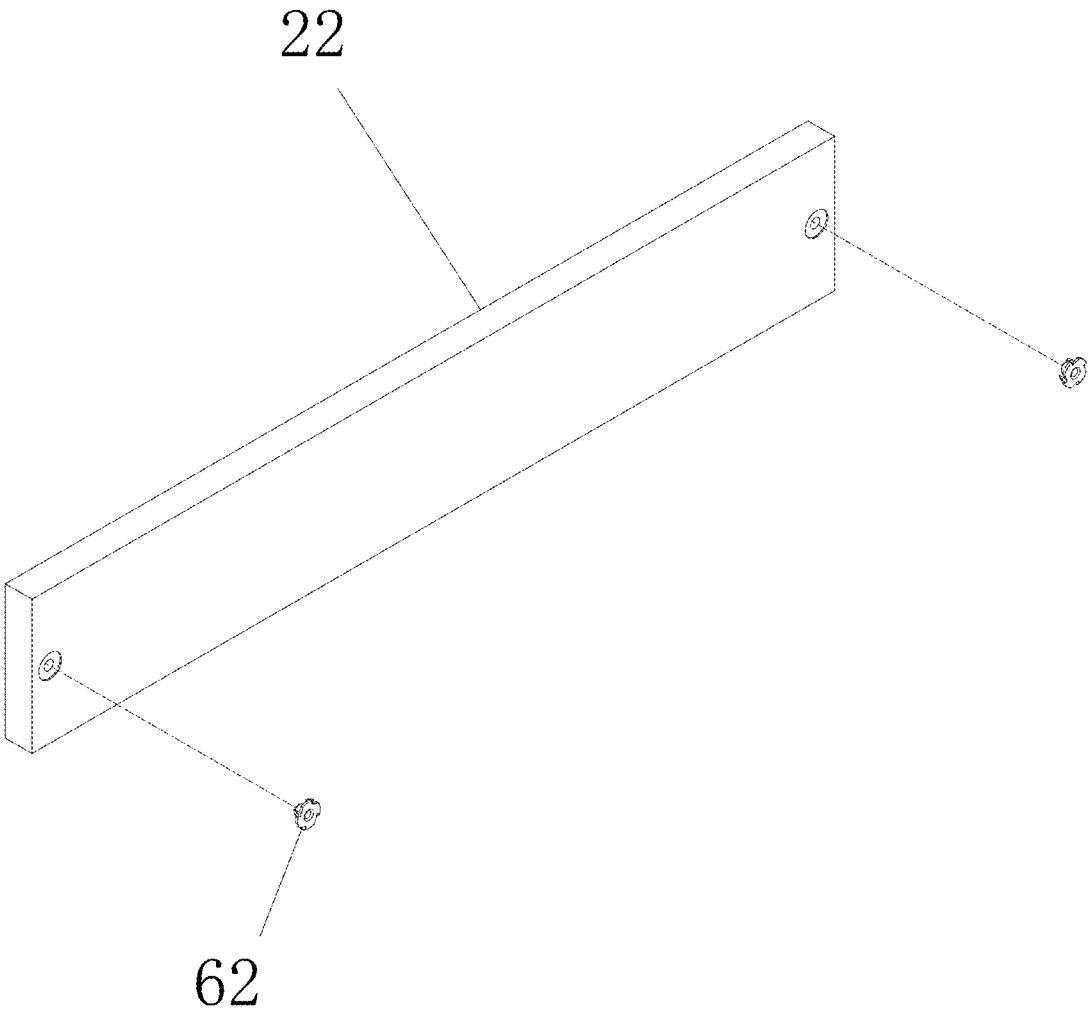
FIG. 8 is a three-dimensional structural schematic diagram of a rigid support strip of the present disclosure.

As shown in FIGS. 1 to 8, a treadmill running platform structure of the present disclosure includes a running platform 1, a running board 2, and a running belt 3. The running platform 1 includes a frame-shaped component 11, and is further provided with a motor 4 configured to drive the running belt to move and a transmission mechanism 5. The running belt 3 is adapted to the running platform 1 through the transmission mechanism 5, and wraps around up and down of the running board 2 from front and back of the running board 2. The frame-shaped component 11 of the running platform 1 is provided with side bars 12 on two opposite sides corresponding to the frame-shape component on two sides of the running platform 1. The running board 2 includes soft elastic strips 21 adapted to the two side bars 12 of the running platform 1, a plurality of rigid support strips 22 adapted between the two soft elastic strips 21, and strip-shaped connection plates 23 respectively connected to two ends of the plurality of rigid support strips 22. Two strip-shaped connection plates 23 are connected above the rigid support strips 22, and the strip-shaped connection plates 23 are respectively fixed to a corresponding end of each pf the rigid support strips 22.

In this embodiment, the strip-shaped connection plates 23 are fixed to a corresponding end of the rigid support strips 22 through a socket head cap screw 61. In an implementation mode, the rigid support strips 22 are provided with four claw nuts 62, and the socket head cap screw 61 passes through the strip-shaped connection plates 23 and the rigid support strips 22 and is threaded with the four claw nuts 62.

In this embodiment, uppers of the soft elastic strips 21 are provided with notch recesses 211, and two ends of the rigid support strips 22 are respectively embedded in the notch recesses 211 of the two soft elastic strips 21.

In this embodiment, stop members 121 are further provided at two ends of the notch recesses 211 corresponding to the soft elastic strips 21 on the side bars 12 of the running platform 1. In an implementation mode, the two ends of the strip-shaped connection plates 23 are fixed to two stop members 121 by screws 63.

In this embodiment, the running board 2 further includes a thin wear-resistant plate 24, and the thin wear-resistant plate 24 covers tops of the plurality of rigid support strips 22.

In this embodiment, one end of the thin wear-resistant plate 24 is fixed to one corresponding rigid support strip 22, and the other end of the thin wear-resistant plate 24 is clamped on a top of another corresponding rigid support strip 22.

In this embodiment, one end of the thin wear-resistant plate 24 is fixed to the corresponding rigid support strip 22 by a countersunk screw 7.

In this embodiment, corresponding ends of the strip-shaped connection plates 23 are provided with a clamping piece 8, and the other end of the thin wear-resistant plate 24 is clamped onto the corresponding rigid support strips 22 through the clamping piece 8.

In this embodiment, the clamping piece 8 is a Z-shaped metal sheet, one end of the Z-shaped metal sheet is fixed to the corresponding end of the strip connection plate 22 by a screw 64, and the other end of the Z-shaped metal sheet presses the other end of the thin wear-resistant plate 24 against the corresponding rigid support strip 22.

In this embodiment, the transmission mechanism 5 includes a front drum 51, and the present disclosure further includes a rear drum 9. The front drum 51 and the rear drum 9 are respectively provided between the two side bars 12 of the running platform 1 and correspond to front and rear positions of the treadmill. The running belt 3 is wound between the front drum 51 and the rear drum 9.

In this embodiment, an armrest frame 10 is further provided, and a front end of the running platform 1 is installed on the armrest frame 10. In this embodiment, the two strip-shaped connection plates 23 are thin spring steel plates.

The treadmill structure of the present disclosure adopts the running board 2, which includes soft elastic strips 21 adapted to the two side bars 12 of the running platform 1, the plurality of rigid support strips 22 adapted between the two soft elastic strips 21, and strip-shaped connection plates 23 respectively connected to the two ends of the plurality of rigid support strips 22. The two strip-shaped connection plates 23 are connected above the rigid support strips 22, and the strip-shaped connection plates 23 are respectively fixed to the corresponding ends of each rigid support strip 22. The structure of the present disclosure achieves elastic buffering of the entire running platform 1 through the soft elastic strips 21 on the two side bars 12, especially by connecting the rigid support strips together through the strip-shaped connection plates, thereby avoiding the occurrence of uneven transition of the rigid support strips when the runner steps on the running board, improving the comfort of the runner's feet, and the soft elastic strips 21 can provide buffering effect on the side bars 12, thereby eliminating the noise generated by the treadmill movement.

The above is only preferred embodiments of the present disclosure and does not limit the present disclosure in any form. Although the present disclosure has been disclosed in the preferred embodiments, it is not intended to limit the present disclosure. Any skilled person familiar with this field may use the disclosed technical content to make many possible changes and modifications to the technical solution of the present disclosure, or modify it into equivalent embodiments without departing from the scope of the technical solution of the present disclosure. Therefore, any simple modifications, equivalent changes, and modifications made to the above embodiments based on the technical essence of the present disclosure that do not depart from the technical solution of the present disclosure shall fall within the protection scope of the technical solution of the present disclosure.

What is claimed is:

1. A treadmill running platform structure, comprising a running platform, a running board, and a running belt;

the running platform comprises a frame-shaped component, and is further provided with a motor configured to drive the running belt to move and a transmission mechanism;

the running belt is adapted to the running platform through the transmission mechanism and wraps around up and down of the running board from front and back of the running board;

two sides of the frame-shaped component of the running platform are provided with side bars on opposite sides of the corresponding frame-shaped component;

wherein the running board comprises soft elastic strips adapted to the side bars of the running platform, a plurality of rigid support strips provided between the two soft elastic strips, and strip-shaped connection plates respectively connected to two ends of the plurality of rigid support strips;

the strip-shaped connection plates are connected above the rigid support strips, and the strip-shaped connection plates are respectively fixed to a corresponding end of each of the rigid support strips;

wherein the strip-shaped connection plates are thin spring steel plates.

2. The treadmill running platform structure according to claim 1, wherein the strip-shaped connection plates are fixed to corresponding ends of the plurality of rigid support strips through a socket head cap screw.

3. The treadmill running platform structure according to claim 2, wherein the running board further comprises a thin wear-resistant plate, and the thin wear-resistant plate covers on the plurality of rigid support strips.

4. The treadmill running platform structure according to claim 3, wherein one end of the thin wear-resistant plate is fixed to one corresponding rigid support strip of the plurality of rigid support strips, and the other end of the thin wear-resistant plate is clamped on a top of another corresponding rigid support strip of the plurality of rigid support strips.

5. The treadmill running platform structure according to claim 4, wherein corresponding ends of the strip-shaped connection plates are provided with a clamping piece, and the other end of the thin wear-resistant plate is clamped on the corresponding rigid support strip through the clamping piece.

6. The treadmill running platform structure according to claim 5, wherein the clamping piece is a Z-shaped metal sheet, one end of the Z-shaped metal sheet is fixed to the corresponding end of the strip-shaped connection plates by a screw, and the other end of the Z-shaped metal sheet presses the other end of the thin wear-resistant plate against the corresponding rigid support strip.

7. The treadmill running platform structure according to claim 4, wherein one end of the thin wear-resistant plate is fixed to the corresponding rigid support strip by a countersunk screw.

8. The treadmill running platform structure according to claim 1, wherein uppers of the soft elastic strips are provided with notch recesses, and ends of the plurality of rigid support strips are respectively embedded in the notch recesses of the soft elastic strips.

9. The treadmill running platform structure according to claim 8, wherein on the side bars of the running platform, stop members are respectively provided at two ends of the notch recesses corresponding to the soft elastic strips.

* * * * *